US007614408B2

(12) United States Patent
Park et al.

(10) Patent No.: US 7,614,408 B2
(45) Date of Patent: Nov. 10, 2009

(54) APPARATUS FOR CONTROLLING WASHING FLOW OF DISHWASHER

(75) Inventors: Nung Seo Park, Incheon-si (KR); Dae Yeong Han, Seoul (KR); Jae Won Chang, Gyeonggi-do (KR); Si Moon Jeon, Seoul (KR); Sang Heon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 475 days.

(21) Appl. No.: 10/902,181

(22) Filed: Jul. 30, 2004

(65) Prior Publication Data

US 2005/0022849 A1 Feb. 3, 2005

(30) Foreign Application Priority Data

Jul. 31, 2003 (KR) ..... 10-2003-0053172

(51) Int. Cl.
*B08B 3/00* (2006.01)

(52) U.S. Cl. ..... 134/56 D; 134/95.3; 134/57 D; 134/98.1; 134/96.1; 134/58 D

(58) Field of Classification Search ..... 134/56 D, 134/95.3, 57 D, 98.1, 96.1, 58 D
See application file for complete search history.

(56) References Cited

U.S. PATENT DOCUMENTS

| | | | | |
|---|---|---|---|---|
| 4,004,600 | A * | 1/1977 | Corn et al. | 134/57 D |
| 6,034,493 | A * | 3/2000 | Boyd et al. | 318/254 |
| 7,047,986 | B2 * | 5/2006 | Ertle et al. | 134/56 D |
| 7,100,623 | B2 * | 9/2006 | Assmann et al. | 134/184 |
| 2003/0168087 | A1 * | 9/2003 | Inui et al. | 134/57 D |

FOREIGN PATENT DOCUMENTS

| | | | |
|---|---|---|---|
| CN | 2191332 | | 3/1995 |
| CN | 2234536 | | 9/1996 |
| CN | 2471978 | | 1/2002 |
| WO | WO/2001/58335 | * | 8/2001 |
| WO | WO/2003/053211 | * | 7/2003 |

* cited by examiner

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

Provided is an apparatus for controlling a washing flow of a dishwasher that can perform an upper washing, a lower washing, an alternate washing of upper and lower sides, and a concurrent washing of upper and lower sides for effective washing.

10 Claims, 9 Drawing Sheets

APPARATUS FOR CONTROLLING WASHING FLOW OF DISHWASHER

BACKGROUND OF THE INVENTION

1. Field of the Invention

The present invention relates to a dishwasher, and more particularly, to an apparatus for controlling a washing flow of a dishwasher that can perform an upper washing, a lower washing, an alternate washing of upper and lower sides, and a concurrent washing of upper and lower sides.

2. Description of the Related Art

In general, a dishwasher is a machine, which washes food remnants adhered to dishes by spraying washing water supplied by a feed pump onto the dishes at a high pressure.

In a method of washing dishes using such a dishwasher, dishes to be washed are loaded in a washing room, washing water is fed to a selected portion of the washing room, heat and pump are operated to heat the fed washing water and to circulate the heated washing water to the pump, the heated and circulated washing water is sprayed on the dishes, thereby separating food remnants adhered to the dishes and washing the dishes.

Also, the dishwashers are classified into single-stage dishwashers and two-stages dishwashers according to the number of a rack employed for washing.

The single-stage dishwashers and the two-stage dishwashers have a difference in the number of the rack, water flow passage structure, but they basically operate using the same operational principle.

In the two-stage dishwashers which perform washing by spraying washing water on dishes through a water flow passage of an upper stage and a water flow passage of a lower stage, researches to save water amount, washing time and washing energy have been actively performed.

FIGS. 1 through 4 illustrate structures of a dishwasher for alternate washing of an upper side and a lower side.

Referring to FIGS. 1 through 4, the dishwasher includes: an inner panel 10 designed to accommodate and drain water, a sump 11 disposed at a lower side of the inner panel 10; upper and lower racks 20 and 30 installed to load dishes 1 inside the inner panel 10; upper and lower nozzle arms 21 and 31 disposed adjacent to the racks 20 and 30, for spraying water; a cleaning filter 12 installed in the sump 11, for filtering accommodated washing water; a drain pump 13 and a drain tube 14 disposed at a lower side of the sump 11, for draining washing water; a water current control pump 40 for selectively circulating the water filtered by the cleaning filter 12 to an upper part and a lower part of the inner panel 10; and upper and lower water flow passages 51 and 52 for inducing the filtered water discharged by the water current control pump 40 toward the upper nozzle arm 21 or the lower nozzle arm 41.

As shown in FIGS. 3 and 4, the water current control pump 40 includes a case 41 communicating with a lower portion of the sump 11, and having an inlet 48, and upper and lower discharge holes 42 and 43, a rotational wheel 44 installed in the case 41, and a water current switching valve 45 hinge-coupled to an inner wall of the case 41 between the upper discharge hole 42 and the lower discharge hole 43, having a front end placed adjacent to an outer circumference of the rotational wheel 44, for closing either of the upper and lower discharge holes 42 and 43 by water current formed according to variation in the rotational direction of the rotational wheel 44.

The water current switching valve 45 includes two shield plates 47 integrally formed in a V shape with a predetermined angle therebetween, and a hinge shaft 46 coupled to a junction portion of the two shield plates 47.

Also, the water current control pump 40 rotates forward or backward (i.e., clockwise or counterclockwise) at a constant period to supply washing water to the upper rack and the lower rack 20 and 30 alternatively, so that washing is performed at a maximum capacitance of the pump 40 and energy consumption is minimized.

Next, operation of the related art dishwasher for alternate washing of an upper side and a lower side will be described with reference to the accompanying drawings.

FIGS. 1 and 3 illustrate an operational state of the related art dishwasher for alternate washing of an upper side and a lower side, and FIGS. 2 and 4 are sectional views of a water current control pump 40 employed in the related art dishwasher for alternate washing of an upper side and a lower side.

Specifically, FIG. 1 shows that washing water is sprayed only on the lower lack 30 to perform the alternate lower washing, and FIG. 2 shows that the rotational wheel 44 rotates counterclockwise such that washing water may be sprayed only on the lower rack 30. Also, FIG. 3 shows that washing water is sprayed only toward the upper lack 20 for a predetermined time to perform the alternate lower washing, and FIG. 4 shows that the rotational wheel 44 rotates clockwise such that washing water may be sprayed only toward the upper rack 20.

As shown in FIGS. 1 and 2, to spray washing water only toward the lower rack 30, a predetermined amount of clean water is first supplied from an outside, collected in the sump 11, and then introduced into the water current control pump 40 through the inlet 48.

At this time, the rotational wheel 44 of the water current control pump 40 rotates counterclockwise by a selective control of a controller (not shown), so that the water in the case 41 forms water current counterclockwise by a rotational force of the rotational wheel 44 and thus the shield plate 47 of the water current switching valve 45 of the water current switching valve 45 revolves clockwise about the hinge shaft 46 to close the upper discharge hole 42.

Since the two shield plates 47 of the water current switching valve 45 are fixed in the V-shape, they are pressed while the water current is in contact with inner surfaces of the shield plates 47 during their direction conversion. Finally, the inner water is forcibly drained through the lower discharge hole 43 and is supplied toward the lower rack 30 through the lower nozzle arm 31. At the same time, the water is sprayed upward toward the lower rack 30 through the lower nozzle arm 31, thereby washing the dishes 1 received in the lower rack 30.

After that, the washing water which is sprayed and then contaminated flows down along the inner panel 10, filtered through the cleaning filter 12, collected in the sump 11, again introduced into the water current control pump 40 through the inlet 48, and is again used to wash the dishes 1.

After the above operations are repeated for a predetermined time, the rotational wheel 44 of the water current control pump 40 rotates backward clockwise by a control of the controller, so that washing water is sprayed toward the upper rack 20 as shown in FIGS. 3 and 4.

That is, the water in the case 41 forms water current in the clockwise direction by the rotational force of the rotational wheel 44, thereby allowing the shield plate 47 of the water current switching valve 45 to revolve about the hinge shaft 46 counterclockwise so that the lower discharge hole 43 is closed.

Finally, inner water is forcibly drained through the upper discharge hole 42 and is supplied toward the upper nozzle arm 21 along the upper water flow passage 51. Then, the water is sprayed upward from the upper nozzle arm 21, thereby washing the dishes 1 received in the upper rack 20.

After the dishes 1 received in the upper rack 20 are washed for a predetermined time as above, the alternate lower washing is repeatedly performed. After the alternate upper and lower washing is performed several times, contaminated washing water is sucked into the drain pump 13 and then drained to an outside through the drain pipe 14, thereby completing the washing.

However, in the related art dishwasher, it is impossible to concurrently wash the dishes received in the upper rack 20 and the dishes received in the lower rack 30. Also, it is possible to selectively perform an upper washing or a lower washing, but it is impossible to perform an alternate washing of the upper and lower racks and a concurrent washing of the upper and lower racks.

SUMMARY OF THE INVENTION

Accordingly, the present invention is directed to an apparatus for controlling a washing flow of a dishwasher that substantially obviate one or more problems due to limitations and disadvantages of the related art.

An object of the present invention to provide an apparatus for controlling a washing flow of a dishwasher that can perform an upper washing, a lower washing, an alternate washing of upper and lower sides, and a concurrent washing of upper and lower sides by employing an automatic washing filter above a sump and installing a water introduction control valve having a plurality of inlets and outlets.

Another object of the present invention is to provide a dishwasher having an upright structure in which a valve type pump is used to constitute a branch water flow passage communicating with a water flow passage in a horizontal direction that is a centrifugal direction of a pump and a water flow control valve is installed in the branch water flow passage such that the branch water flow passage communicates with a water flow passage connected to an upper arm and/or a lower arm according to a rotational control of the water flow control valve.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an apparatus for controlling a washing flow of a dishwasher. The apparatus includes: a motor for controlling a spray force for washing; a pump rotated by the motor to discharge washing water; a flow control valve installed on a branch flow passage communicating with a discharge flow passage of the pump, having at least two inlets and outlets, the flow control valve being supplied with the washing water discharged by the pump and discharging the washing water to a discharge flow passage of a lower arm and/or an upper arm; and a rotation controller for controlling rotation of the flow control valve by a washing method determined by a washing amount.

The flow control valve may be a cylindrical type, and comprises; at least two inlets formed at an interval of 90° on a lower circumferential surface; at least two outlets formed at an interval of 90° on an upper circumferential surface; and a rotatable shaft axially coupled with the rotation controller.

Also, the at least two inlets communicating with the discharge passage of the pump and outlets communicating with the drain passage connected to the upper and/or lower arms have positions determined according to revolution of the rotational shaft.

Further, the at least two inlets and outlets formed on the flow control valve has a circumferential surface of which ¾ is formed at an interval of 90°, and ¼ is formed by a shield film, and introduction position and discharge position are determined according to a position of the drain passage connected with the discharge passage of the pump and both the arms.

In particular, the flow control valve is a cylindrical plate shape, and comprises; at least two inlets and outlets formed at an interval of 90° on a circumferential surface thereof; and a drain hole having a predetermined shape and communicating with the drain passage at a different position at an upper surface thereof, according to a position of the inlets.

Preferably, the at least two inlets and outlets of the flow control valve have positions determined depending on an upper washing, a lower side washing, an alternate washing of upper and lower sides, and a washing of both sides.

The flow control valve rotates the at least two inlets and outlets clockwise at an interval of 90°, of which positions are determined depending on an upper washing, a lower side washing, an alternate washing of upper and lower sides, and a washing of both sides.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

First Embodiment

A dishwasher for an alternate washing of upper and lower sides according to the present invention includes: a motor for controlling a spray force for washing; a pump rotated by the motor to discharge washing water; a flow control valve installed on a branch flow passage communicating with a discharge flow passage of the pump, having at least two inlets and outlets, the flow control valve being supplied with the washing water discharged by the pump and discharging the washing water to a discharge flow passage of a lower arm and/or an upper arm; and a rotation controller for controlling rotation of the flow control valve by a washing method determined by a washing amount.

The flow control valve may be a cylindrical type, and comprises; at least two inlets formed at an interval of 90° on a lower circumferential surface; at least two outlets formed at an interval of 90° on an upper circumferential surface; and a rotatable shaft axially coupled with the rotation controller.

Also, the at least two inlets communicating with the discharge passage of the pump and outlets communicating with the drain passage connected to the upper and/or lower arms have positions determined according to revolution of the rotational shaft.

Further, the at least two inlets and outlets formed on the flow control valve has a circumferential surface of which ¾ is formed at an interval of 90°, and ¼ is formed by a shield film, and introduction position and discharge position are determined according to a position of the drain passage connected with the discharge passage of the pump and both the arms.

In particular, the flow control valve is a cylindrical plate shape, and comprises; at least two inlets and outlets formed at an interval of 90° on a circumferential surface thereof; and a drain hole having a predetermined shape and communicating with the drain passage at a different position at an upper surface thereof, according to a position of the inlets.

Preferably, the at least two inlets and outlets of the flow control valve have positions determined depending on an upper washing, a lower side washing, an alternate washing of upper and lower sides, and a washing of both sides.

The flow control valve rotates the at least two inlets and outlets clockwise at an interval of 90°, of which positions are determined depending on an upper washing, a lower side washing, an alternate washing of upper and lower sides, and a washing of both sides.

A washing flow controller of a dishwasher according to the present invention will now be described with reference to the accompanying drawings.

Figure 1:
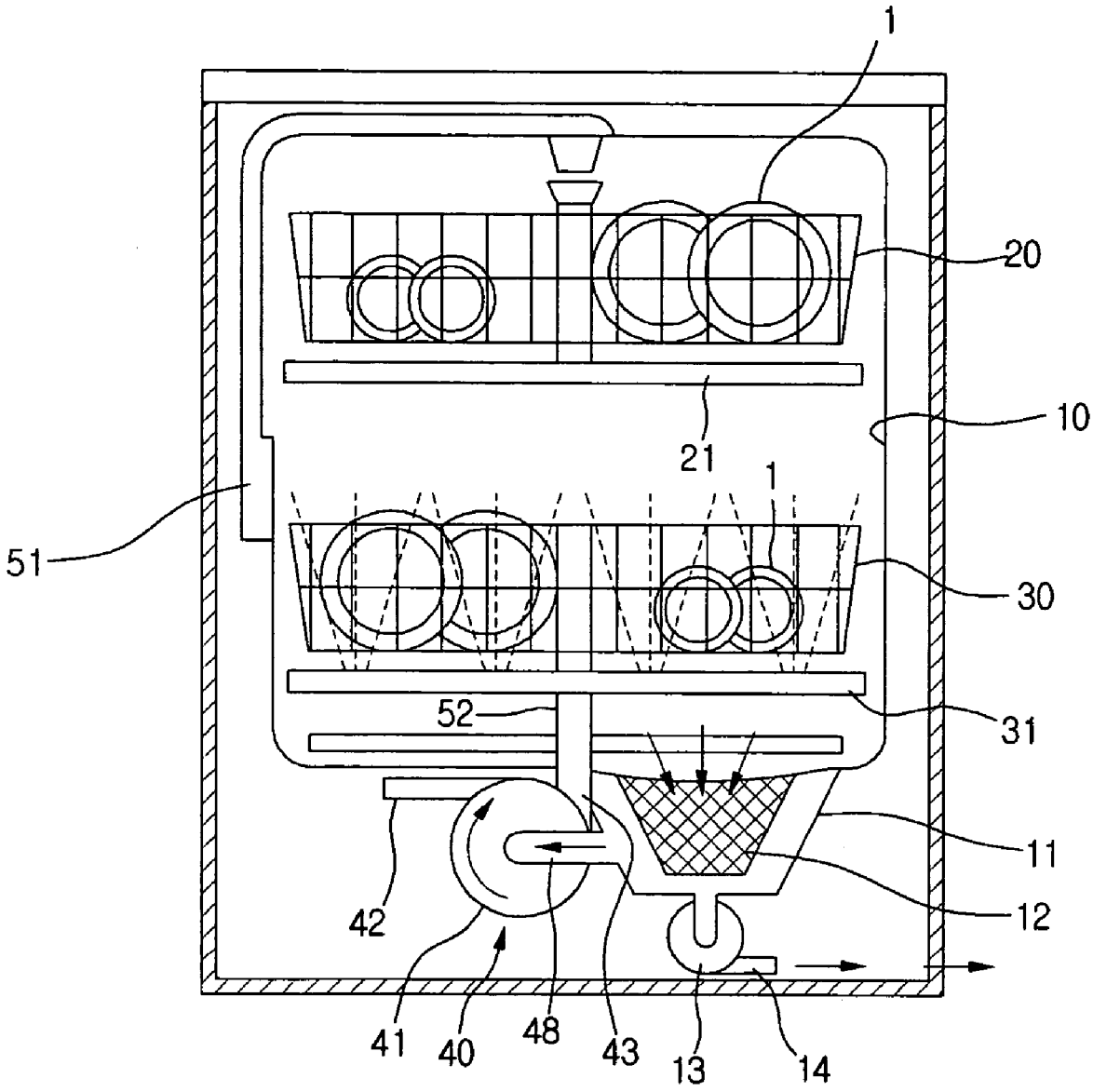
Fig.1 Related Art
FIG. 1 is a schematic view illustrating washing of a lower rack in a related art dishwasher.
Figure 2:
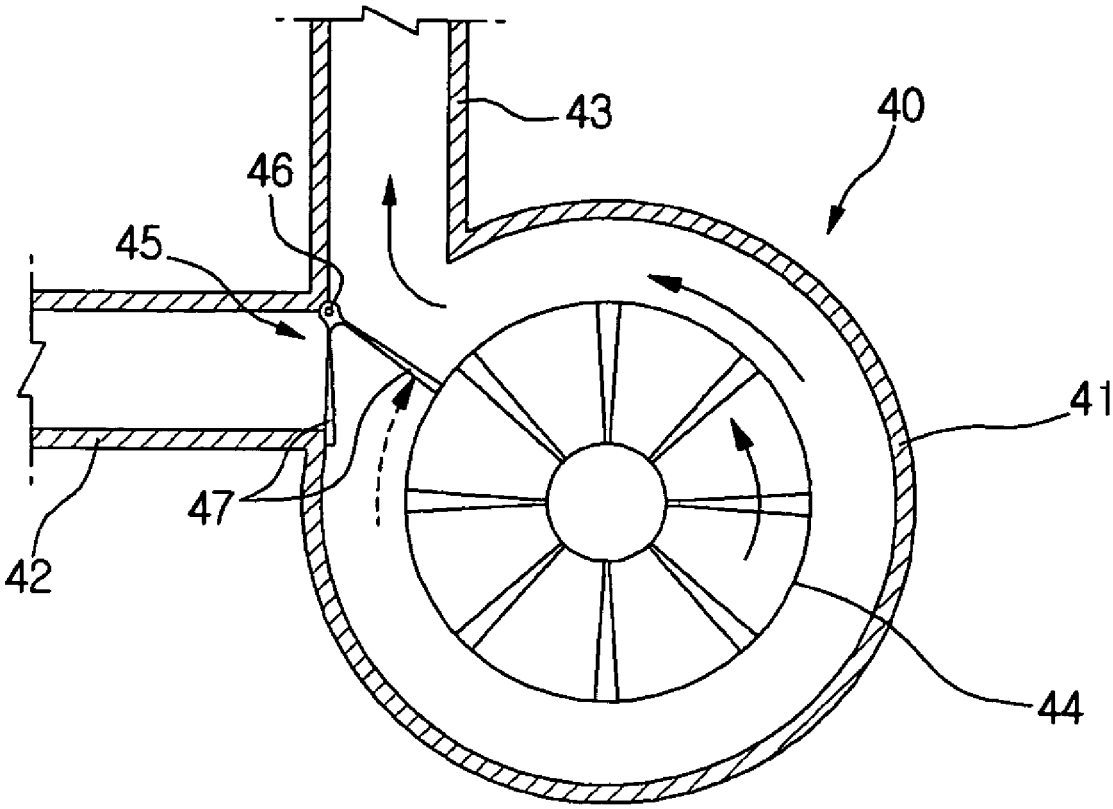
Fig.2 Related Art
FIG. 2 is a structural view of a water current control pump in a related art dishwasher.
Figure 3:
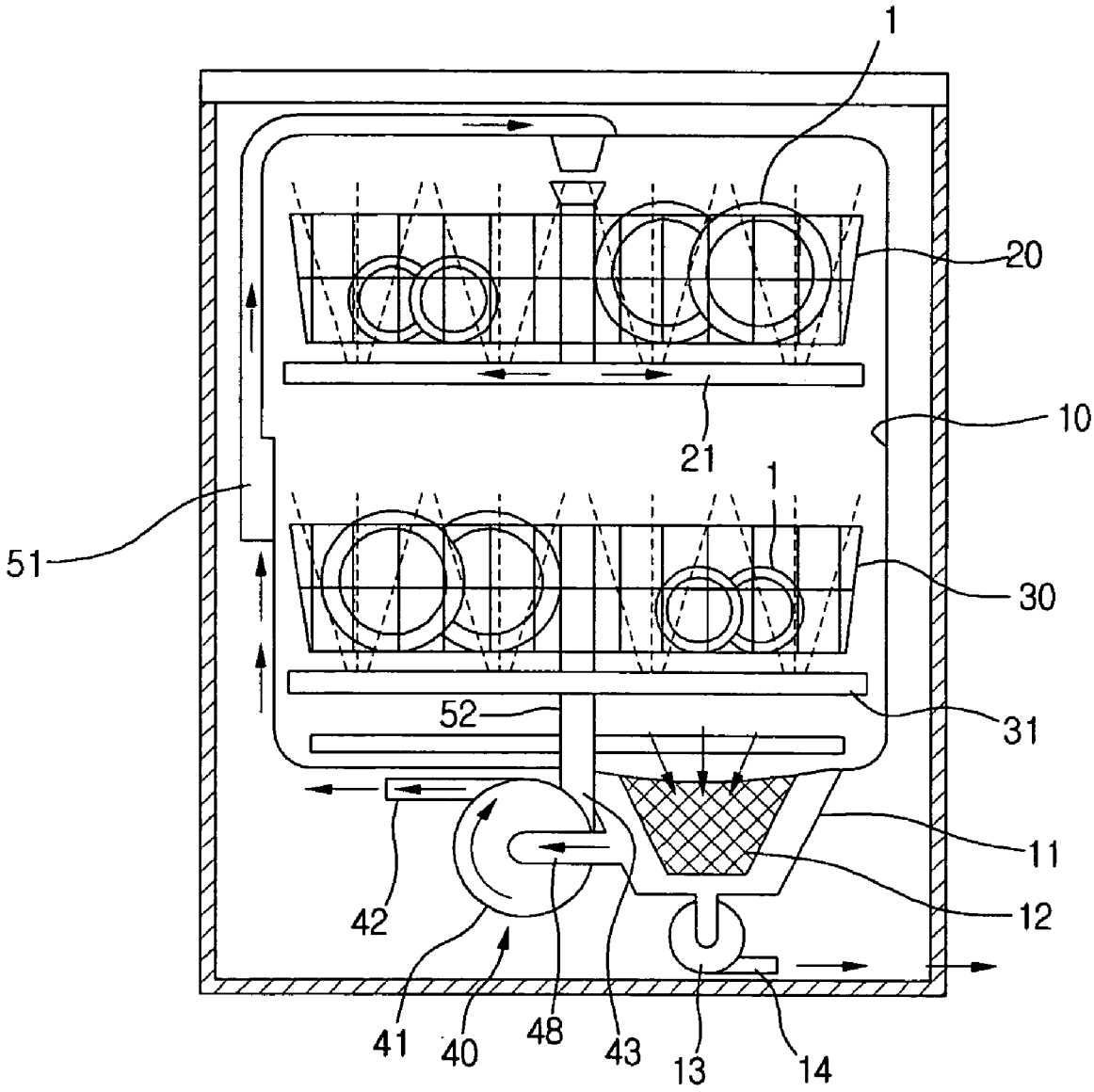
Fig.3 Related Art
FIG. 3 is a schematic view illustrating washing of an upper rack in a related art dishwasher.
Figure 4:
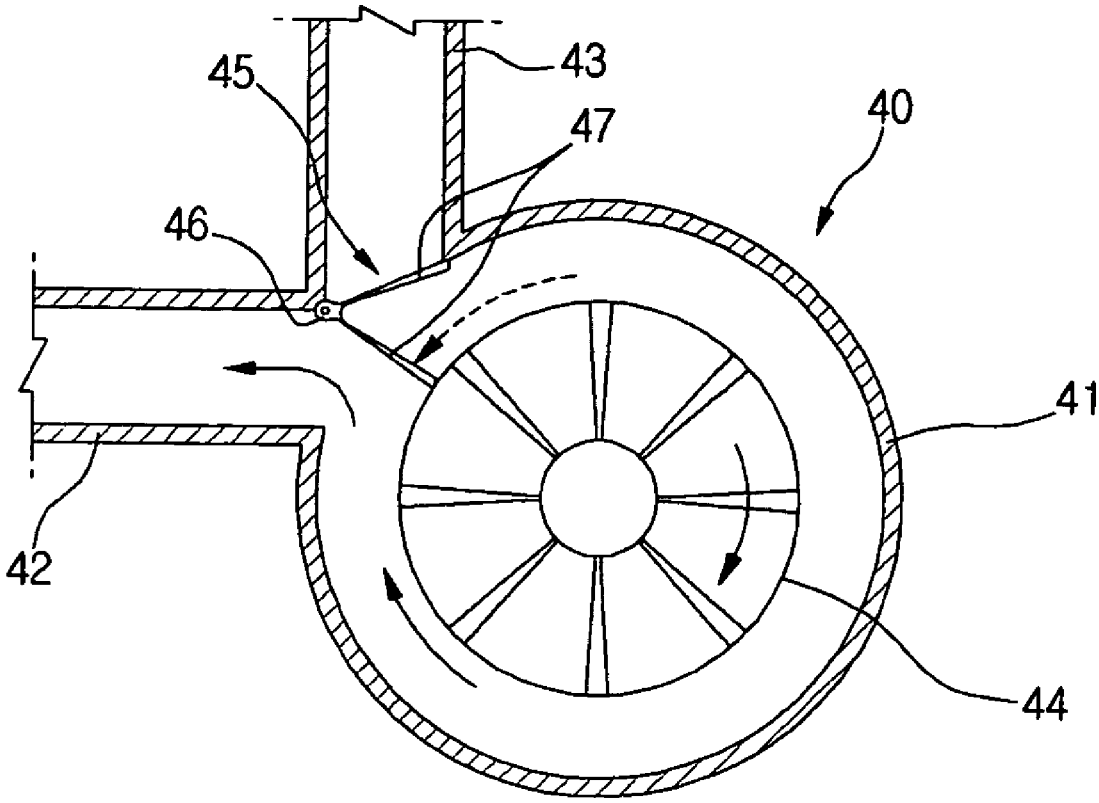
Fig.4 Related Art
FIG. 4 is a structural view of a water current control pump in a related art dishwasher.
Figure 5:
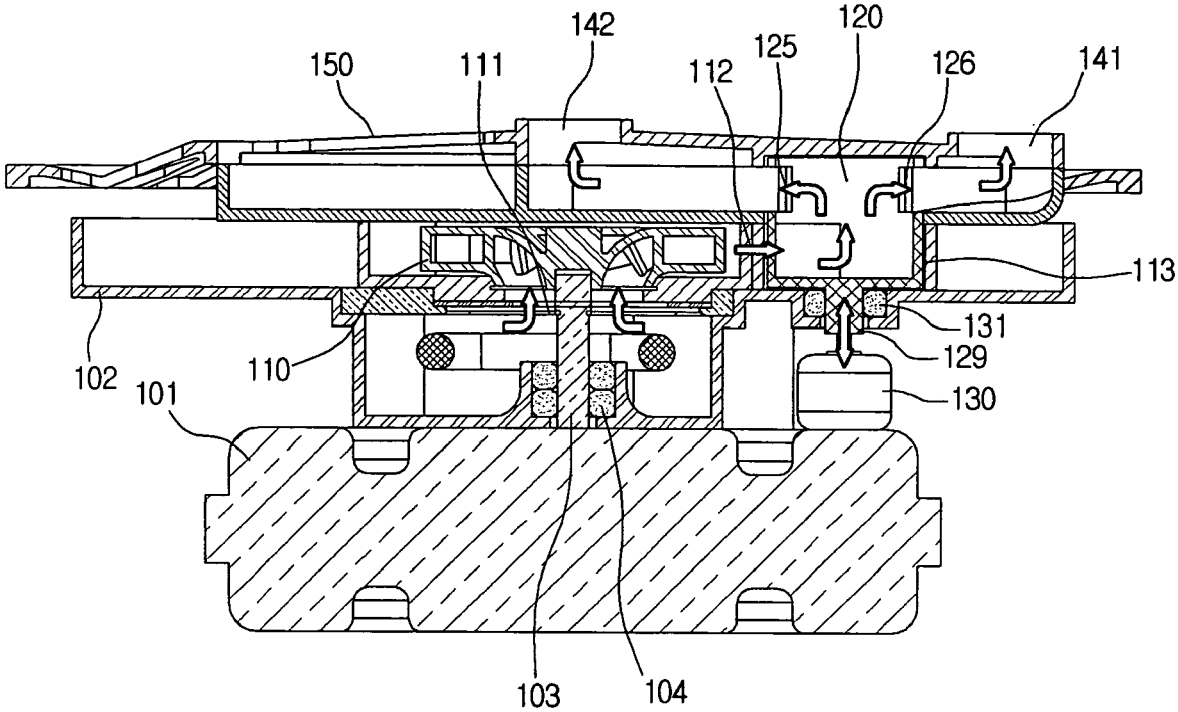
FIG. 5 is a sectional view of a washing flow control apparatus in a dishwasher according to an embodiment of the present invention.

Referring to FIG. 5, a motor 101 installed in a lower side of a dishwasher case is a BLDC motor and generates a driving force. The motor 101 controls revolution of a pump, which is connected to a rotational shaft 103. The rotational shaft 103 is supported by bearings 104 insertedly installed around the rotational shaft 103.

For the purpose of the dishwashing, a predetermined amount of clean washing water is supplied from an outside and collected in a sump 102. Then, the collected washing water is sucked into the pump 110 through an inlet 111.

The washing water discharged by the pump 110 is introduced into a flow control valve 120, which is installed in a branch passage 113 horizontally communicating with a discharge passage 112.

Figure 6:
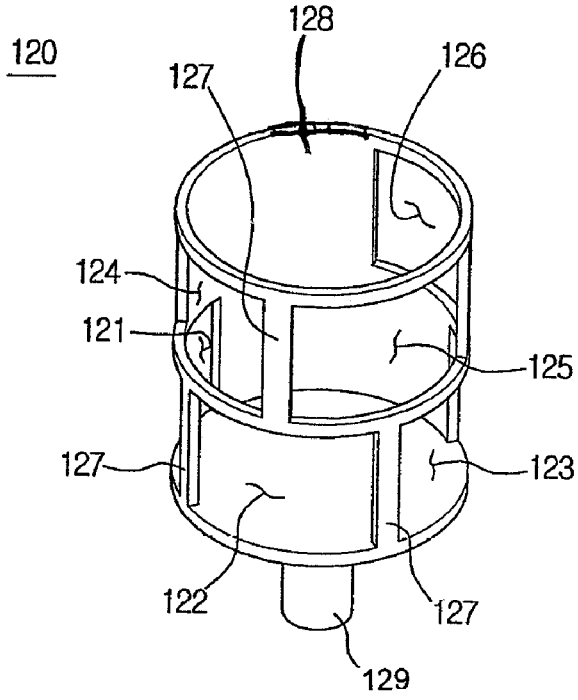
FIG. 6 is a perspective view of a flow control valve in a dishwasher according to a first embodiment of the present invention.

As the first embodiment, referring to FIG. 6, the flow control valve 120 includes a plurality of inlet 121, 122 and 123 and a plurality of outlet 124, 125 and 126, which are provided as one body. One or more inlets 121, 122 and 123 communicating with the discharge passage 112 of the pump 110 and one or more outlets 124, 125 and 126 are determined depending on an upper washing, a lower washing, an alternate washing of upper and lower sides, and a concurrent washing of upper and lower sides.

In more detail, the flow control valve 120 is made in a cylindrical shape. A plurality of inlets 121, 122 and 123 are formed on a lower side at an interval of 90°, and a plurality of outlets are formed on an upper side at an interval of 90°. In other words, the inlets and outlets are formed as much as ¾ of the circumference of the valve.

Also, the inlets 121, 122 and 123 and the outlets 124, 125 and 126, which are formed at the upper and lower sides of the flow control valve 120, are formed crossing one another with respect to the horizontal line. A boundary frame 127 is formed between each inlet 121, 122 and 123 and each outlet 124, 125 and 126, and the remaining portion in which the inlets 121, 122 and 123 and the outlets 124, 125 and 126 are not formed acts as a shield film 128.

The inlets 121, 122 and 123 and the outlets 124, 125 and 126 can be formed at different positions depending on the discharge passage 112 and the drain passage 141 and 142 communicating with the arm.

A valve rotation shaft 129 of the flow control valve 120 is connected to a cam 130 depending on a user's selection, so that a clockwise (or counterclockwise) rotation is controlled at an interval of 90° to introduce and discharge the washing water through the inlets and the outlets on the passage predefined according to the upper washing, the lower washing, the alternate washing of upper and lower sides, and the concurrent washing of upper and lower sides.

The flow control valve 120 is disposed on the horizontal passage, which is the radial direction of the pump. The passages 141 and 142 connected with the upper and lower arms are disposed at the same position within the automatic washing filter 150.

Figure 7:
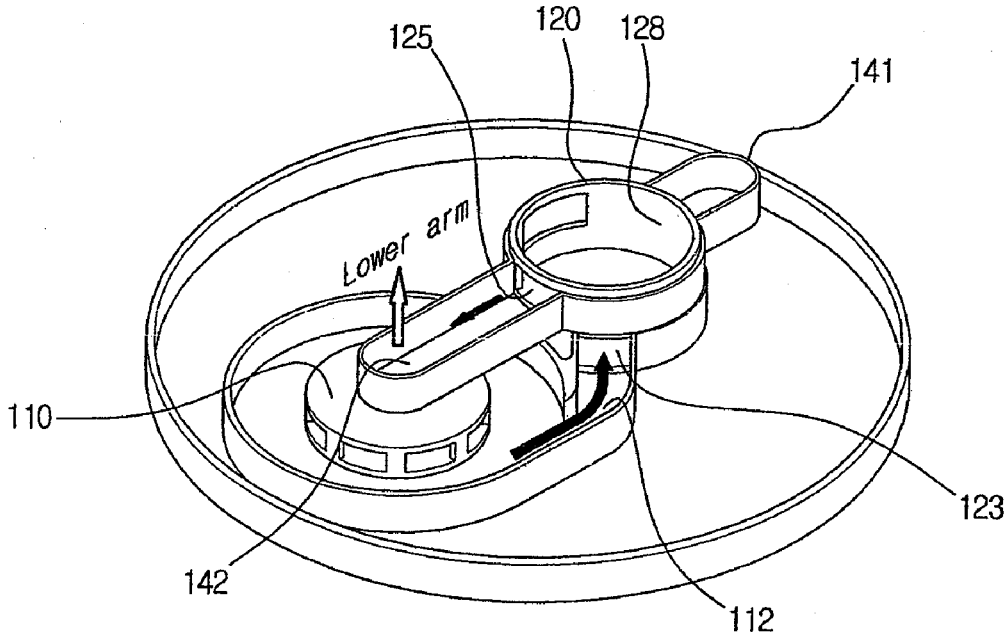
FIG. 7 is a perspective view showing that the flow control valve of FIG. 6 is used for a lower washing.

FIG. 7 is a view of an application example of the flow control valve, showing a lower washing state.

Referring to FIG. 7, the third inlet 123 communicates with the discharge passage 112 of the pump 110 and the second outlet 125 communicates with a discharge passage 142 of the lower arm 110, so that the flow control valve can communicate with a drain passage 142 of the lower arm.

Under this condition, the washing water from the pump 110 is discharged to the second outlet 125 through the third inlet 123 disposed at a lower side of the flow control valve 120. Then, the washing water is discharge to the drain passage 142 connected to the lower arm.

In this manner, the washing water is sprayed toward a lower rack through the lower arm, thereby washing the dishes received in the lower rack.

The shield film 128 of the flow control valve functions to shield so that the flow control valve cannot communicate with the drain passage.

Figure 8:
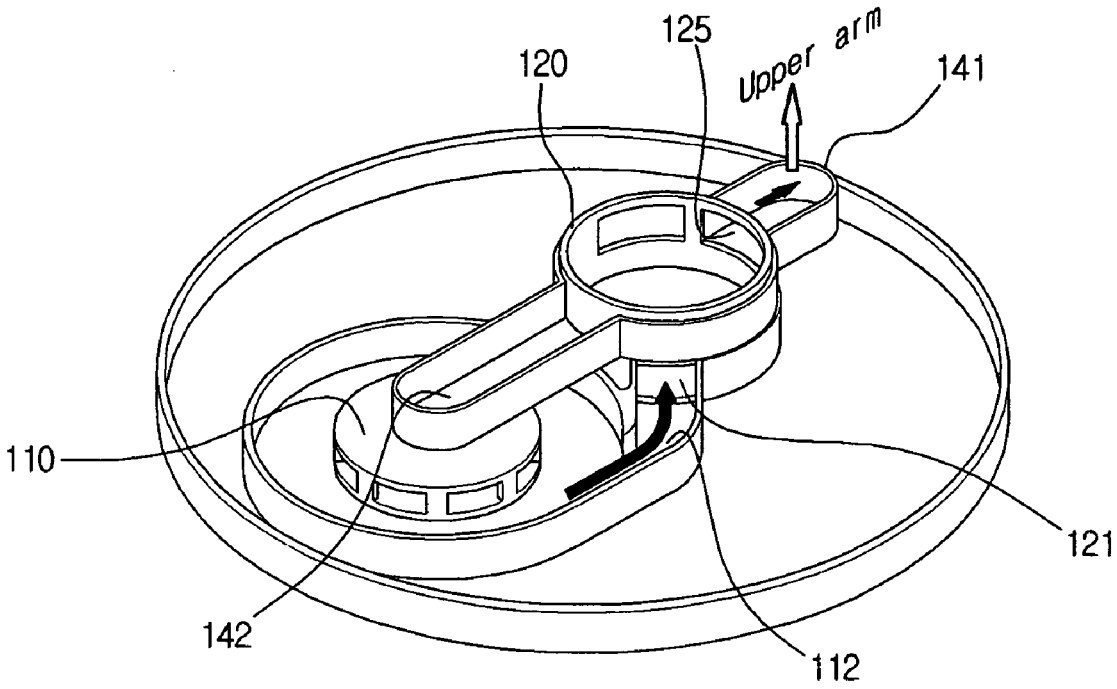
FIG. 8 is a perspective view showing that the flow control valve of FIG. 6 is used for an upper washing.

FIG. 8 is an application example of the flow control valve of FIG. 6, shows an upper washing state.

Referring to FIG. 8, the second inlet 125 communicates with the drain passage 141 of the upper arm, so that the first inlet 121 can communicate with the discharge passage 112 of the pump 110.

Under this condition, the washing water from the pump 110 is introduced through the first inlet 121 on the lower side of the flow control valve 120 connected with the discharge passage 112, and then, it is discharged to the drain passage 141 connected with the upper arm. Therefore, the washing water is sprayed toward the upper rack through the upper arm, thereby washing the dishes received in the upper rack.

Also, the third inlet 123 and the second outlet 125, or the first inlet 123 and the second outlet 125 of the flow control valve 120 are respectively controlled to be alternately rotated by the lower arm and the upper arm, so that the alternate washing from the lower arm to the upper arm is possible.

Figure 9:
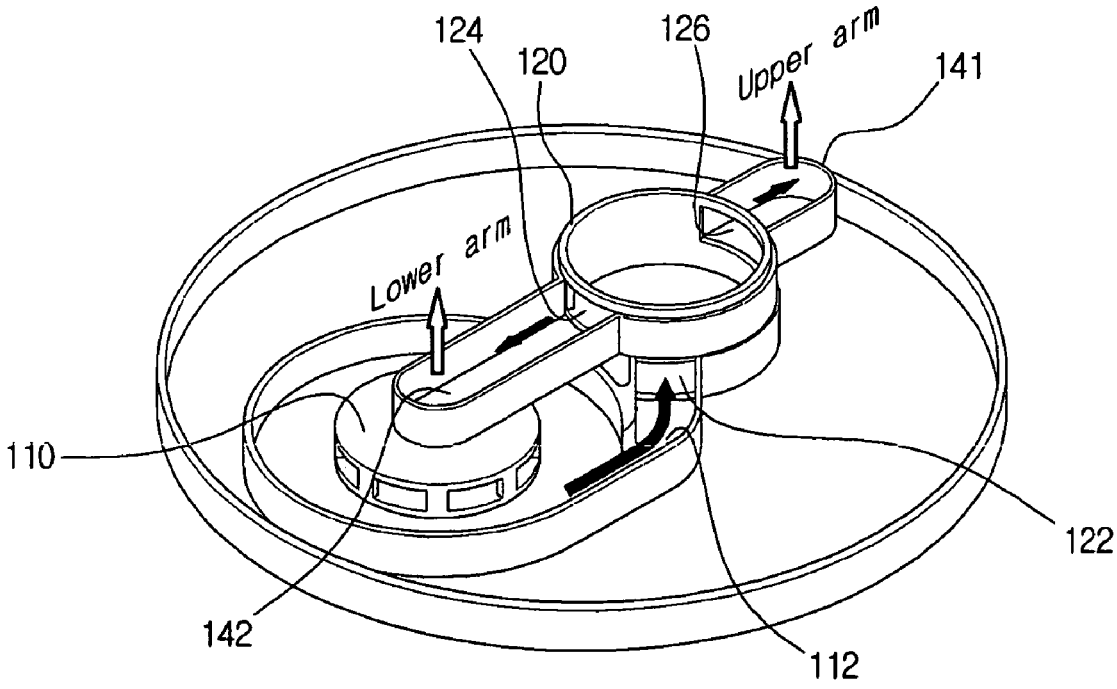
FIG. 9 is a perspective view showing that the flow control valve of FIG. 6 is used for a concurrent washing of lower and upper sides.

FIG. 9 is an application example of the flow control valve of FIG. 6, showing a concurrent washing of upper and lower sides.

Referring to FIG. 9, in order for the flow control valve 120 to introduce and discharge the washing water to both sides, the second inlet 122 communicates with the discharge passage 112 of the pump 110, and the first and third outlets 124 and 126 communicates with the discharge passages of the lower arm and the upper arm.

Under this condition, the washing water is introduced into the second inlet 122 formed at the lower side of the flow control valve 120, which communicates with the discharge passage of the pump 110. Then, it is discharged through the first and third outlets 124 and 126 to the passage 141 and 142, which are respectively connected with the lower the upper arms.

Therefore, the washing water is sprayed upwards through the upper and the lower arms to the upper and the lower racks, thereby washing the dishes received in the upper and the lower racks.

Since a rotational speed of the motor can be controlled by a BDLC motor during the concurrent washing, it is possible to maintain the same spray force during the concurrent washing by increasing revolution of the pump.

Second Embodiment

Figure 10:
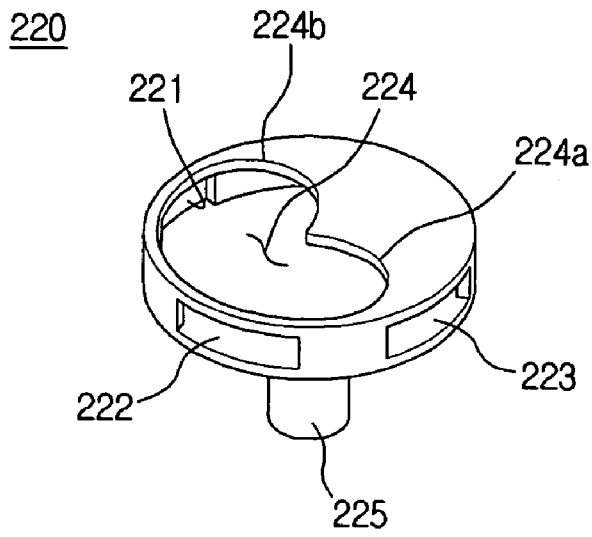
FIG. 10 is a perspective view of a flow control valve in a dishwasher according to a second embodiment of the present invention.

FIG. 10 is a perspective view of a flow control valve in a dishwasher according to a second embodiment of the present invention.

The flow control valve 220 is formed in a cylindrical plate shape. The flow control valve 220 is applied to the case where a lower arm is positioned just over the flow control valve having a relative low height.

Three inlet/outlets 221, 222 and 223 are formed on a side surface of a circumference of the flow control valve. Three inlet/outlets 221, 222 and 223 are spaced apart from one another at an interval of 90° and in a direction of width and at a ¾ portion of the circumference. Heart-shaped lower arm outlet port 224 is formed on a ½ portion of an upper surface of the flow control valve 220. The lower arm outlet 224 is comprised of a right outlet 224*a* and a left outlet 224*b*.

As an example, a heart-shape of the lower arm outlet 224 functions to communicate with the discharge passage connected with the lower arm depending on a position of the laterally disposed inlet, and the lower arm outlet 224 can have a plurality of outlets separated.

Further, a rotatable shaft is downwardly protruded at a lower end of the flow control valve 220 such that rotation control can be made at an interval of 90° and clockwise (or counterclockwise).

An example of the flow control valve 220 is described with reference to the drawings as follows.

Figure 11:
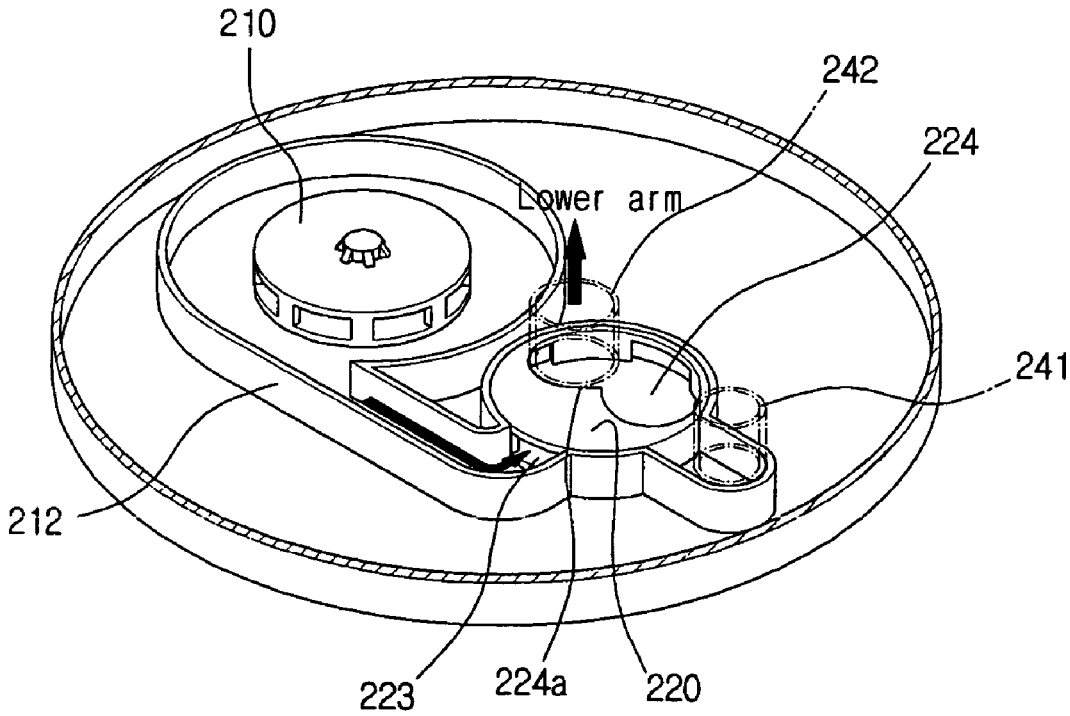
FIG. 11 is a perspective view showing that the flow control valve of FIG. 10 is used for a lower washing.

FIG. 11 is a perspective view showing that the flow control valve of FIG. 10 is used for a lower washing.

Referring to FIG. 11, the first inlet 223 of the flow control valve 220 is disposed to communicate with a drain passage 212 of the pump 210. The upper left outlet 224*a* communicates with the discharge passage 242 connected with the lower arm.

Then, the washing water of the pump 210 is introduced into the drain passage 212 and the third inlet 223 of the flow control valve 220, and then is discharged into the discharge passage 242 through the left outlet 224*a*. Accordingly, the washing water upwardly sprays toward a lower rack through the lower arm connected with the discharge passage 242 while washing the dish housed in the lower rack.

Figure 12:
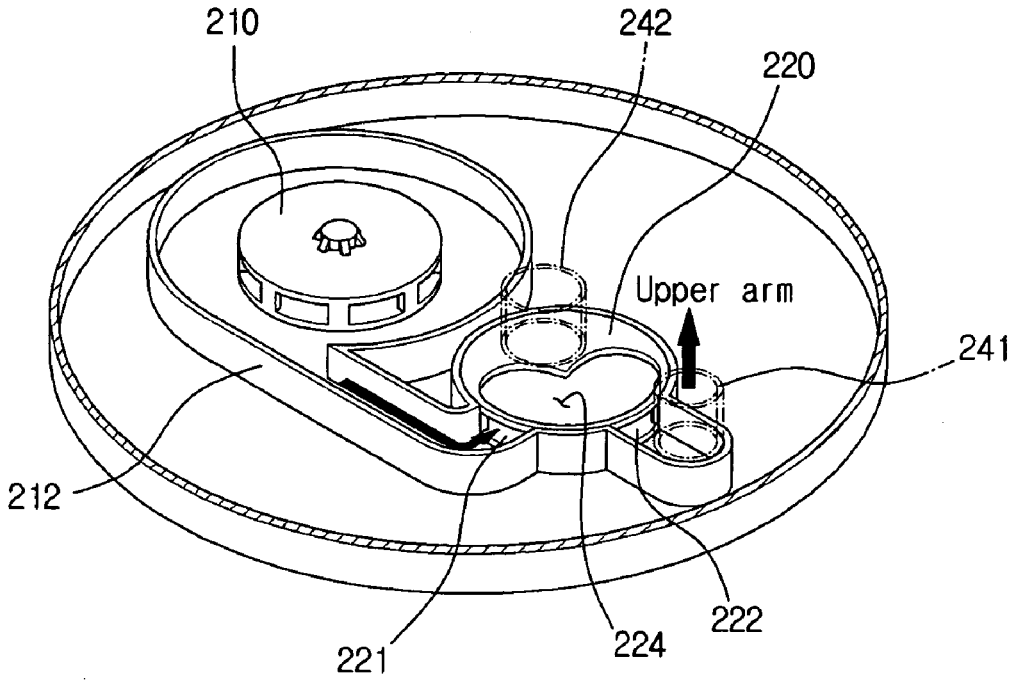
FIG. 12 is a perspective view showing that the flow control valve of FIG. 10 is used for an upper washing.

FIG. 12 is a perspective view showing that the flow control valve of FIG. 10 is used for an upper washing.

Referring to FIG. 12, the first inlet 221 of the flow control valve 220 is disposed to communicate with the drain passage 212 of the pump 210. The lateral outlet 222 communicates with the discharge passage 241 connected with an upper arm.

Then, the washing water of the pump 210 is introduced into the drain passage 212 and the first inlet 221 of the flow control valve 220, and then is discharged into the discharge passage 241 through the lateral outlet 224*a*. Accordingly, the washing water upwardly sprays toward an upper rack through the lower arm connected with the discharge passage 242 while washing the dishes received in the upper rack.

Additionally, the operation states of FIGS. 11 and 12 are used to control a lower rotatable shaft 225 of the flow control valve 220 such that the user can set the number of rotation. As a result, alternate washing can be made to the upper arm or the lower arm.

Figure 13:
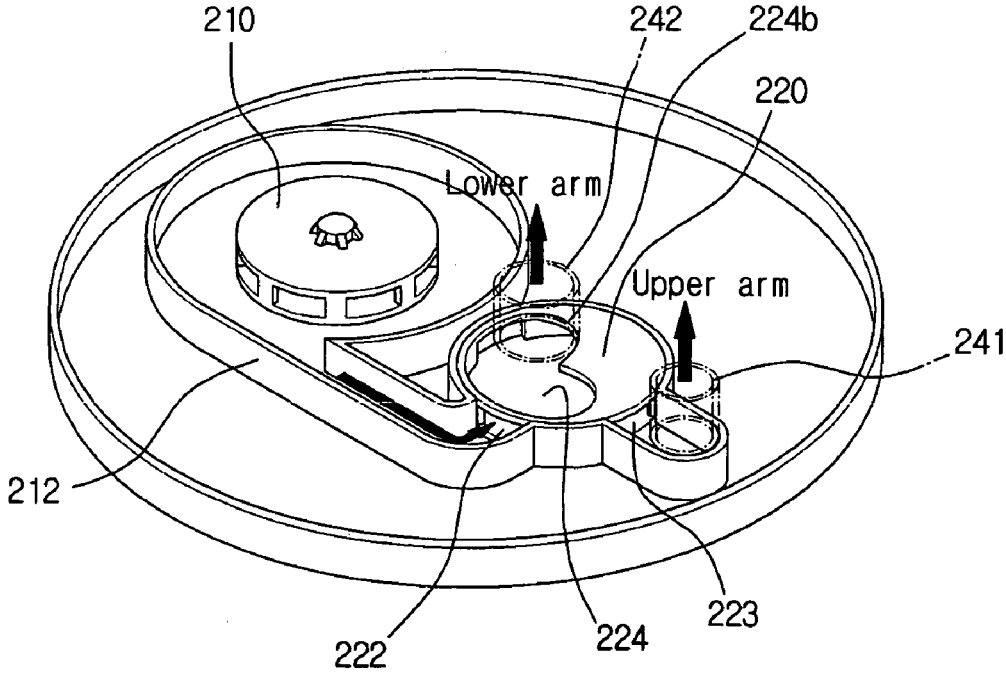
FIG. 13 is a perspective view showing that the flow control valve of FIG. 10 is used for a concurrent washing of lower and upper sides.

FIG. 13 is a perspective view showing that the flow control valve of FIG. 10 is used for a concurrent washing of lower and upper sides.

Referring to FIG. 13, the second inlet 222 of the flow control valve 220 is disposed to communicate with the drain passage 212 of the pump 210. The upper one side outlet 224*b* and the lateral outlet 223 communicate with the discharge passages 241 and 242 of the lower arm and the upper arm.

The washing water from the pump 210 is introduced into the discharge passage 212 and the second inlet of the flow control valve 220 and is discharged through the upper and lower outlets 224*a* and 222 to the drain passages 241 and 242.

The washing water is sprayed upwards to the upper and lower racks through the lower and upper arms connected to the drain passages 241 and 242, thereby washing the dishes received in the upper and lower racks.

Here, in the concurrent washing, revolution of the motor is controlled using the motor so as to maintain the same spray force as the upper or lower washing.

In one embodiment, the flow control valve can be provided in various shapes, for example, a cylindrical shape or a circular plate shape.

In the discharge passage and the drain passage of the arms, the position and size of the inlet and the outlet are determined depending to the washing method. The inlet and outlet can be formed on the circumferential surface in a rectangular or circular shape.

Also, the present invention is characteristic of at least two inlets and outlets. The rotation shaft of the lower side is interfaced depending on the washing method, so that the upper washing, the lower washing, the alternate washing and the concurrent washing are possible.

According to the present invention, the dishwasher is provided with the flow control valve having at least one inlet and outlet. Therefore, the user can select one of the above washing methods, so that an efficient washing is possible.

Also, the flow control valve can be installed within the automatic washing filter passage by installing it within the branch passage, and the low sump structure can be provided.

Further, the spray force of the arm nozzle can be constantly maintained by controlling the revolution of the motor.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for controlling a washing flow of a dishwasher, the apparatus comprising:

a motor configured to control a spray force for washing;

a pump rotated by the motor to discharge washing water;

a flow control valve positioned at a branch flow passage communicating with a discharge flow passage of the pump, the flow control valve having a plurality of inlets and a plurality of outlets receiving the washing water discharged by the pump and discharging the washing water to a discharge flow passage of a lower arm and/or an upper arm; and a rotation controller configured to control rotation of the flow control valve in accordance with a washing method determined by a washing amount, wherein communication of the plurality of outlets with the discharge flow passage of at least one of the lower arm and the upper arm is determined based upon a selective communication of one of the plurality of inlets with the discharge flow passage of the pump, wherein when the one of the plurality of inlets communicates with the discharge flow passage of the pump, another of the plurality of the inlets is closed, wherein when the one of the plurality of inlets communicates with the discharge flow passage of the pump, at least one of the plurality of outlets communicates with the discharge flow passage of the lower arm or the upper arm, and wherein when another of the plurality of inlets communicates with the discharge flow passage of the pump, one of the plurality of outlets communicates with the discharge flow passage of the lower arm and another of the plurality of outlets communicates with the discharge flow passage of the upper arm.

2. The apparatus of claim 1, wherein the motor is a BLDC motor that controls a revolution of the pump so as to maintain an identical spray force for an upper side washing, a lower side washing, an alternate washing of upper and lower sides, and a washing of both sides.

3. The apparatus of claim 1, wherein the flow control valve is a cylindrical type including plurality of inlets comprising three inlets spaced at 90° intervals on a lower circumferential surface, the plurality of outlets comprising three outlets spaced at 90° intervals on an upper circumferential surface, and a rotatable shaft axially coupled with the rotation controller.

4. The apparatus of claim 3, wherein the plurality of inlets and the plurality of outlets of the flow control valve each have a circumferential surface of which ¾ of the circumferential surface is defined by the plurality of inlets and the plurality of outlets spaced at 90° intervals, and ¼ of the circumferential surface is defined by a shield film, and an introduction position and a discharge position are determined according to a position of the plurality of inlets and the plurality of outlets of the flow control valve connected with the discharge passage of the pump and both the lower and upper arms.

5. The apparatus of claim 1, wherein the flow control valve rotates the plurality of inlets and the plurality of outlets clockwise at 90° intervals, wherein positions of the plurality of inlets and the plurality of outlets are determined depending on an upper side washing, a lower side washing, an alternate washing of upper and lower sides, and a washing of both sides.

6. An apparatus for controlling a washing flow of a dishwasher, the apparatus comprising:

a motor configured to control a spray force for washing;

a pump rotated by the motor to discharge washing water;

a flow control valve positioned at a branch flow passage communicating with a discharge flow passage of the pump, the flow control valve having a plurality of inlets and a plurality of outlets receiving the washing water discharged by the pump and discharging the washing water to a discharge flow passage of a lower arm and/or an upper arm; and a rotation controller configured to control rotation of the flow control valve in accordance with a washing method determined by a washing amount, wherein the plurality of inlets comprises a first inlet, a second inlet, and a third inlet and when one of the plurality of inlets communicates with the discharge passage of the pump, the others of the plurality of inlets are closed and at least one of the plurality of outlets communicates with one of the discharge flow passage of the lower arm and the upper arm.

7. The apparatus of claim 6, wherein when one of the first inlet and the third inlet communicates with the discharge passage of the pump, one of the plurality of outlets communicates with the discharge flow passage of the lower arm or the upper arm, and when the second inlet communicates with the discharge passage of the pump, another of the plurality of outlets communicates with the discharge flow passage of the lower arm and the other of the plurality of outlets communicates with the discharge flow passage of the upper arm.

8. An apparatus for controlling a washing flow of a dishwasher, the apparatus comprising:

a motor configured to control a spray force for washing;

a pump rotated by the motor to discharge washing water;

a flow control valve positioned at a branch flow passage communicating with a discharge flow passage of the pump, the flow control valve having a plurality of openings and at least one outlet receiving the washing water discharged by the pump and discharging the washing water to a discharge flow passage of a first arm and/or an second arm; and a rotation controller configured to control rotation of the flow control valve in accordance with a washing method determined by a washing amount, wherein one of the plurality of openings selectively communicates with the discharge flow passage of the pump, and the plurality of openings comprise a first opening, a second opening and a third opening, wherein when the first opening communicates with the discharge flow passage of the pump, the second opening communicates with the discharge flow passage of the first arm and the discharge flow passage of the second arm is closed, and wherein when the third opening communicates with the discharge flow passage of the pump, the at least one outlet communicates with the second arm and the discharge flow passage of the first arm is closed.

9. The apparatus of claim 8, wherein when the second opening communicates with the discharge flow passage of the pump, the third opening communicates with the first arm and the outlet communicates with the second arm.

10. The apparatus of claim 9, wherein the flow control valve is a cylindrical plate shape, the first, second and third openings each spaced at 90° intervals on a circumferential surface of the flow control valve.

* * * * *